US012453448B1

(12) United States Patent
Van Ess

(10) Patent No.: US 12,453,448 B1
(45) Date of Patent: Oct. 28, 2025

(54) DISPOSABLE COVER FOR A TOILET AND SURROUNDING AREA

(71) Applicant: Joseph Vincent Van Ess, Mechanicsville, VA (US)

(72) Inventor: Joseph Vincent Van Ess, Mechanicsville, VA (US)

( * ) Notice: Subject to any disclaimer, the term of this patent is extended or adjusted under 35 U.S.C. 154(b) by 227 days.

(21) Appl. No.: 18/211,642

(22) Filed: Jun. 20, 2023

(51) Int. Cl.
*A47K 13/16* (2006.01)

(52) U.S. Cl.
CPC ..... *A47K 13/16* (2013.01)

(58) Field of Classification Search
CPC ..... A47K 13/14; A47K 13/16; A47K 13/18
USPC ..... 4/245.1, 245.3–245.8, 251.1, 901
See application file for complete search history.

(56) References Cited

U.S. PATENT DOCUMENTS 3,524,203 A * 8/1970 Ruggles ..... A47K 17/00 4/901
5,067,185 A * 11/1991 Kohler ..... A47K 13/16 4/245.1
6,711,756 B1 * 3/2004 Mollendor ..... A47K 13/16 4/245.3
6,968,578 B2 11/2005 Bernsley
10,342,360 B2 7/2019 Calhoun
2003/0221248 A1 12/2003 Bedley
2006/0288470 A1 12/2006 Nnaji
2010/0319114 A1 * 12/2010 Andre ..... A47K 13/14 4/245.1
2012/0246811 A1 10/2012 Sayre
2018/0344109 A1 12/2018 Lucas
2019/0014959 A1 1/2019 Mardukhayev
2019/0029452 A1 1/2019 Rodriguez
2021/0282606 A1 * 9/2021 Mulligan ..... A47K 13/16
2022/0248918 A1 8/2022 Carmona
2022/0273145 A1 9/2022 Bernstein

FOREIGN PATENT DOCUMENTS

WO 2018026732 2/2018

* cited by examiner

*Primary Examiner* — Tuan N Nguyen
(74) *Attorney, Agent, or Firm* — Kyle A. Fletcher, Esq.

(57) ABSTRACT

The disposable cover for a toilet and surrounding area incorporates a sacrificial sheeting, a plurality of adhesive structures, and a toilet facility. The plurality of adhesive structures secures the sacrificial sheeting to the toilet facility. The sacrificial sheeting forms a protected space that protects the toilet facility from the environment. The sacrificial sheeting keeps the toilet facility in a clean state.

8 Claims, 4 Drawing Sheets

DISPOSABLE COVER FOR A TOILET AND SURROUNDING AREA

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of sanitary accessories for bathrooms. (E03D9/00)

SUMMARY OF INVENTION

The disposable cover for a toilet and surrounding area incorporates a sacrificial sheeting, a plurality of adhesive structures, and a toilet facility. The plurality of adhesive structures secures the sacrificial sheeting to the toilet facility. The sacrificial sheeting forms a protected space that protects the toilet facility from the environment. The sacrificial sheeting keeps the toilet facility in a clean state.

These together with additional objects, features and advantages of the disposable cover for a toilet and surrounding area will be readily apparent to those of ordinary skill in the art upon reading the following detailed description of the presently preferred, but nonetheless illustrative, embodiments when taken in conjunction with the accompanying drawings.

In this respect, before explaining the current embodiments of the disposable cover for a toilet and surrounding area in detail, it is to be understood that the disposable cover for a toilet and surrounding area is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the disposable cover for a toilet and surrounding area.

It is therefore important that the claims be regarded as including such equivalent construction insofar as they do not depart from the spirit and scope of the disposable cover for a toilet and surrounding area. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
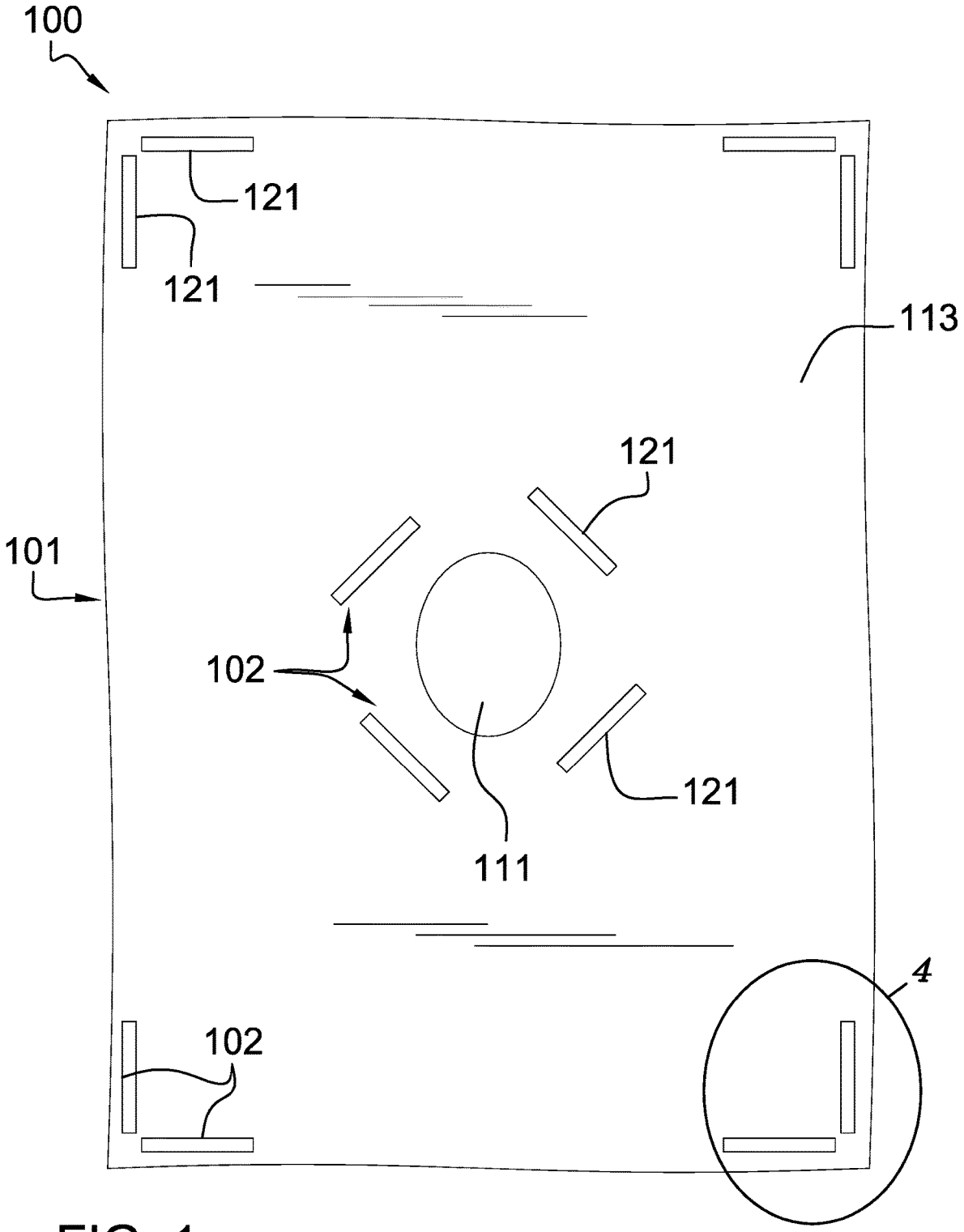
FIG. 1 is an interior view of an embodiment of the disclosure.
Figure 2:
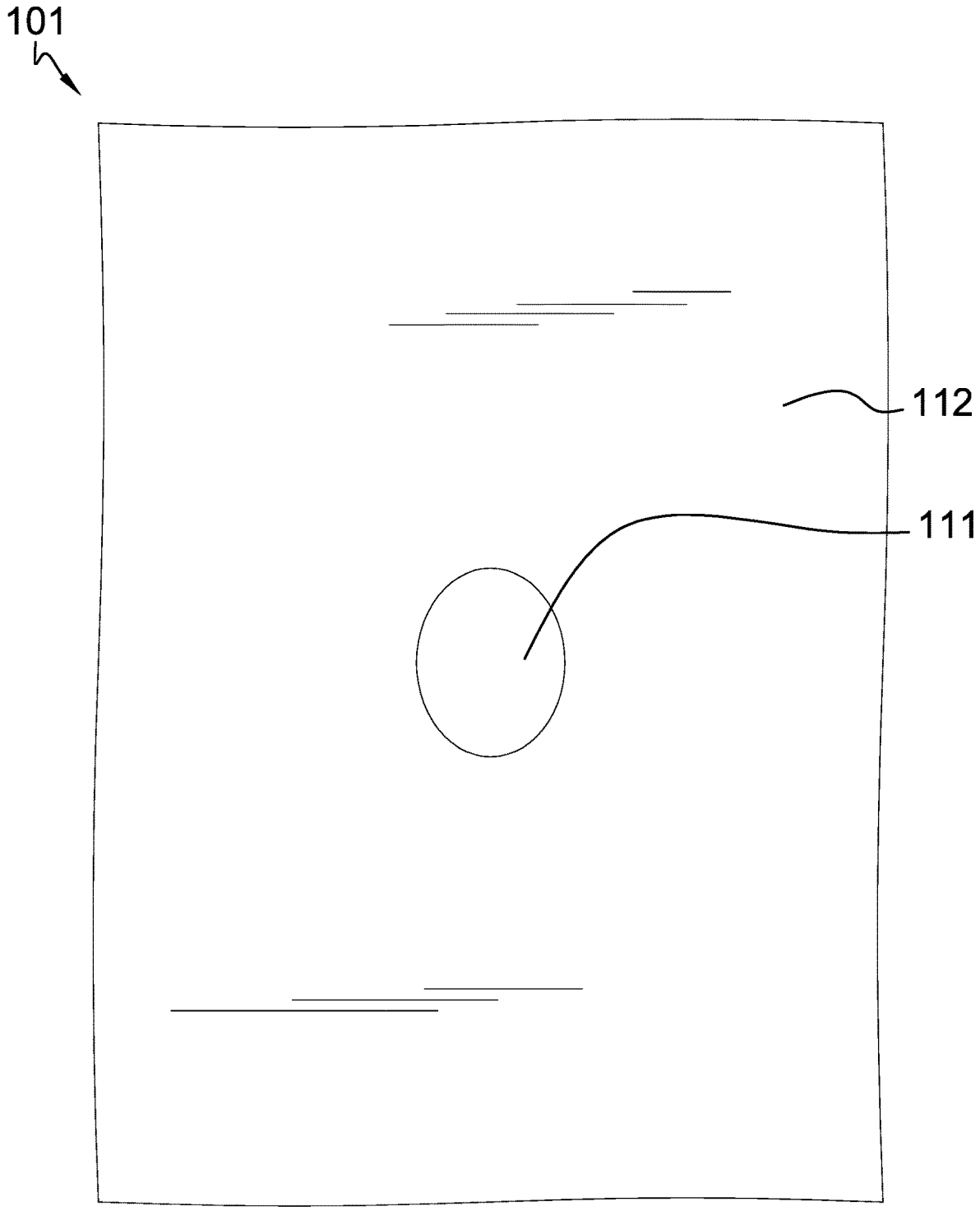
FIG. 2 is an exterior view of an embodiment of the disclosure.
Figure 3:
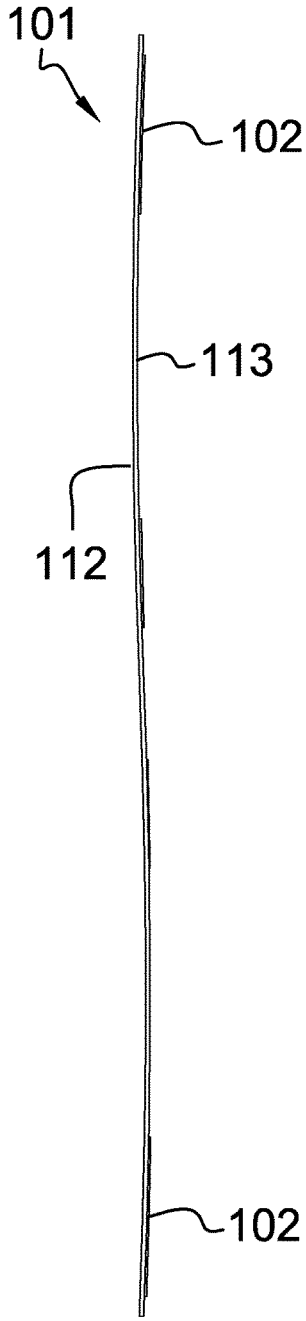
FIG. 3 is a side view of an embodiment of the disclosure.
Figure 4:
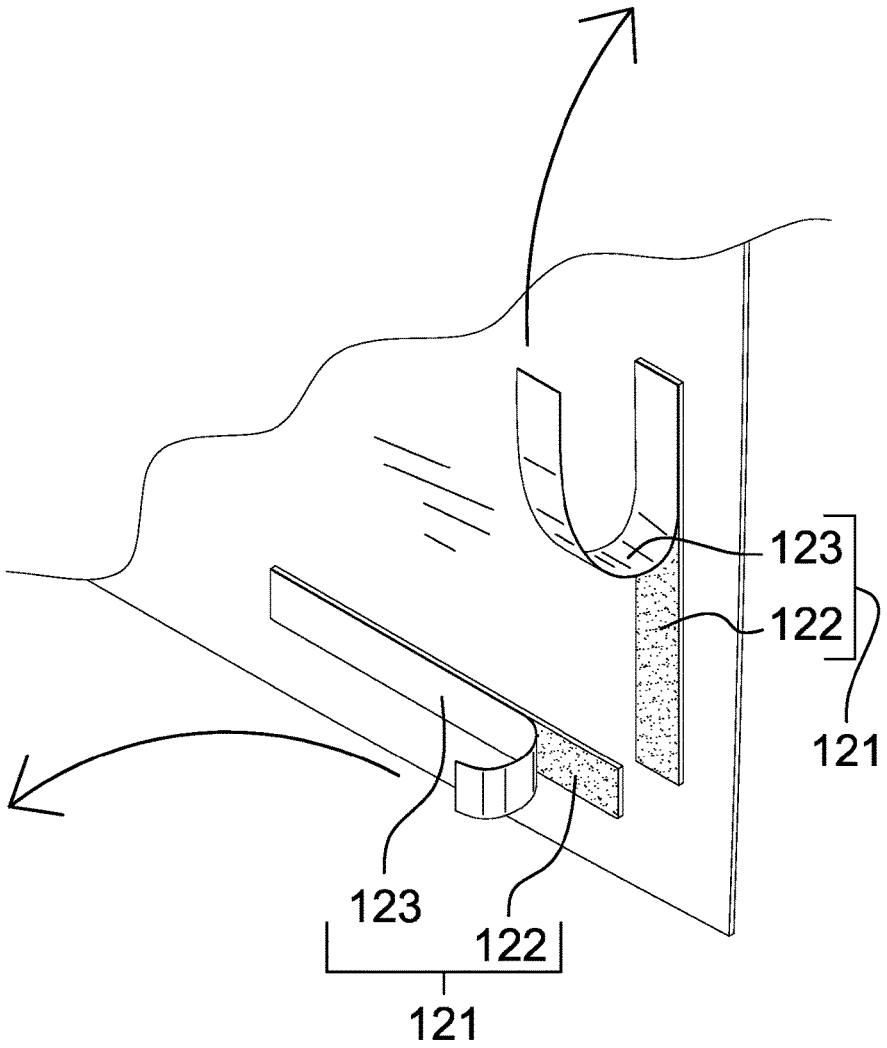
FIG. 4 is a detail view of an embodiment of the disclosure.
Figure 5:
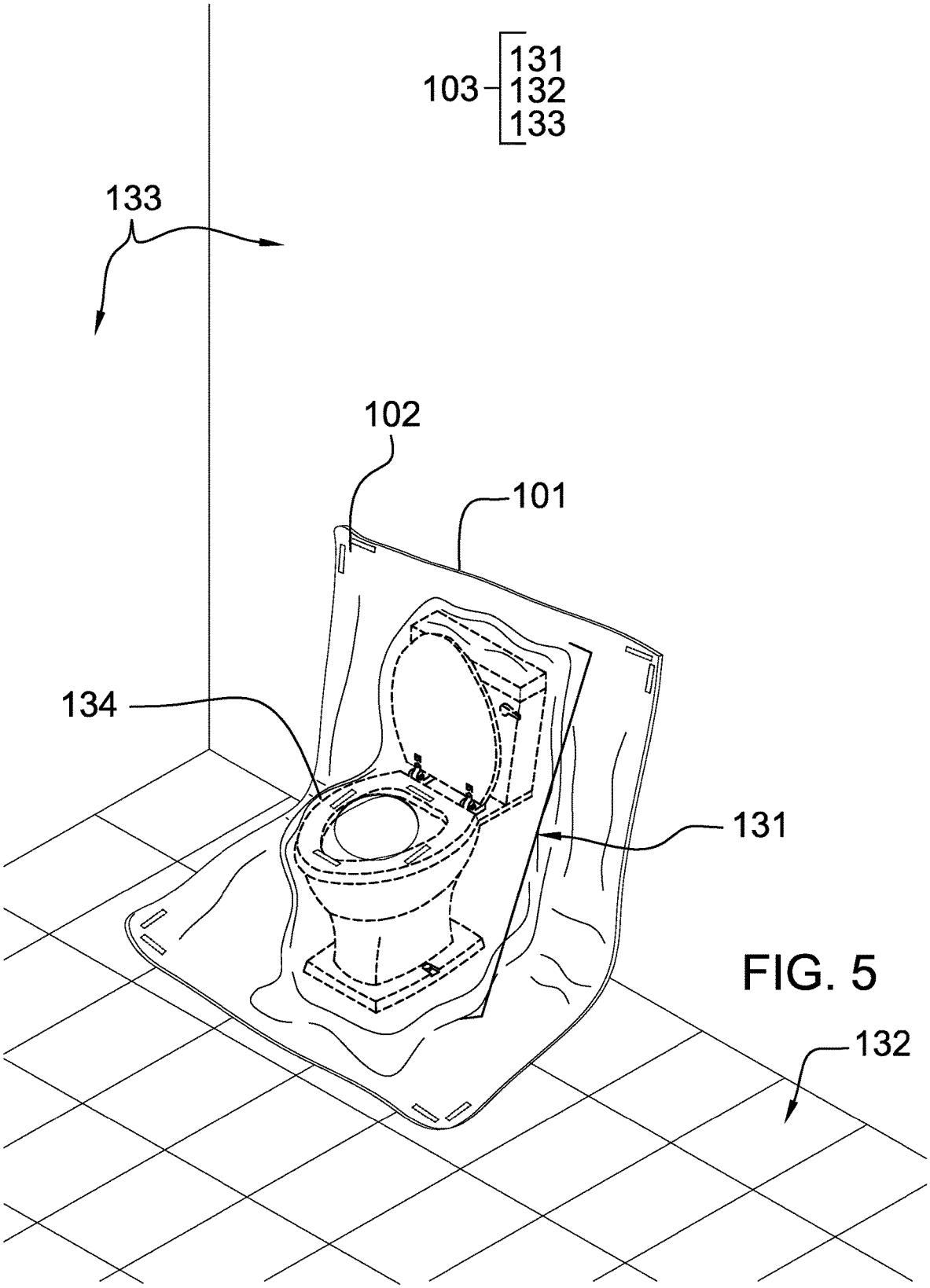
FIG. 5 is an in-use view of an embodiment of the disclosure.

Detailed reference will now be made to one or more potential embodiments of the disclosure, which are illustrated in FIGS. 1 through 5.

The disposable cover for a toilet and surrounding area 100 (hereinafter invention) comprises a sacrificial sheeting 101, a plurality of adhesive structures 102, and a toilet facility 103. The plurality of adhesive structures 102 secures the sacrificial sheeting 101 to the toilet facility 103. The sacrificial sheeting 101 forms a protected space that protects the toilet facility 103 from the environment. The sacrificial sheeting 101 keeps the toilet facility 103 in a clean state.

The toilet facility 103 is a facility that is intended to receive eliminations and excretions from an individual. The toilet facility 103 transports the received eliminations and excretions to a DWV. The toilet facility 103 comprises a toilet structure 131, a supporting surface 132, and one or more enclosing surfaces 133.

The toilet structure 131 is a toilet. The toilet structure 131 is the facility that physically receives the eliminations and excretions. The toilet is defined elsewhere in this disclosure. The toilet structure 131 further comprises a bowl structure 134. The bowl structure 134 is the bowl of the toilet structure 131. The bowl structure 134 is the port that receives the eliminations and excretions. The bowl structure 134 is defined elsewhere in this disclosure.

The supporting surface 132 is a horizontally oriented surface. The supporting surface 132 forms the surface that receives the load of the toilet facility 103. Each enclosing surface selected from the one or more enclosing surfaces 133 is a vertically oriented surface. The one or more enclosing surfaces 133 are used to form a space that protects the privacy of individuals using the toilet structure 131.

The sacrificial sheeting 101 is a sheeting structure. The sacrificial sheeting 101 is a flexible structure. The sacrificial sheeting 101 is a fluid impermeable structure. The sacrificial sheeting 101 is formed from a material selected from the group consisting of: a) a plastic; and, b) a parchment. The sacrificial sheeting 101 is formed as a ring. The sacrificial sheeting 101 is a disposable structure. The sacrificial sheeting 101 is intended for a single use.

The sacrificial sheeting 101 forms a boundary structure. The sacrificial sheeting 101 forms a protected space that encloses the toilet facility 103. The sacrificial sheeting 101 forms a barrier that prevents liquid and solid phase substances from soiling the toilet structure 131 of the toilet facility 103. The plurality of adhesive structures 102 removably attaches the sacrificial sheeting 101 to the toilet structure 131. The plurality of adhesive structures 102 removably attaches the sacrificial sheeting 101 to the supporting surface 132. The plurality of adhesive structures 102 removably attaches the sacrificial sheeting 101 to the one or more enclosing surfaces 133.

The sacrificial sheeting 101 comprises a characteristic aperture 111, an exterior face 112, and an interior face 113.

The characteristic aperture 111 is a negative space that forms the characteristic aperture 111 of the ring structure of the sacrificial sheeting 101. The characteristic aperture 111 provides a port that allows eliminations and excretions to be deposited into the bowl structure 134 of the toilet facility 103.

The interior face 113 is a face of the sheeting that forms the sacrificial sheeting 101. The interior face 113 is the face of the sacrificial sheeting 101 that is proximal to the toilet structure 131 when the sacrificial sheeting 101 is deployed on the toilet facility 103. The exterior face 112 is a face of the sheeting that forms the sacrificial sheeting 101. The exterior face 112 is the face of the sacrificial sheeting 101 that is distal from the interior face 113.

The plurality of adhesive structures 102 forms an adhesive structure. The plurality of adhesive structures 102 secures the sacrificial sheeting 101 to the toilet structure 131, the supporting surface 132, and the one or more enclosing surfaces 133. The plurality of adhesive structures 102 is formed with a removable adhesive. The plurality of adhesive structures 102 maintain the deployed sacrificial sheeting 101 in a fixed position on the toilet facility 103. The plurality of adhesive structures 102 comprises a collection of individual adhesive structures 121. Each individual adhesive structure 121 selected from the plurality of adhesive structures 121 comprises an adhesive coating 122 and a peel-off strip 123.

Each adhesive coating 122 selected from the plurality of adhesive structures 121 is a chemical compound. Each selected adhesive coating 122 is a removable adhesive. Each selected adhesive coating 122 is applied as a coating to the one or more enclosing surfaces 133 of the sacrificial sheeting 101. The selected adhesive coating 122 attaches the sacrificial sheeting 101 to a surface selected from the group consisting of: a) the toilet structure 131; b) the supporting surface 132, and, c) the one or more enclosing surfaces 133.

The peel-off strip 123 is a parchment. The shape of the peel-off strip 123 is geometrically identical to the shape of the coating formed by the adhesive coating 122. The peel-off strip 123 attaches to the adhesive coating 122 such that the adhesive coating 122 is protected from dirt, debris, and environmental factors while the invention 100 is stored. The peel-off strip 123 is removed before the adhesive coating 122 is adhered to a receiving surface.

The following definitions were used in this disclosure:

Adhesive: As used in this disclosure, an adhesive is a chemical substance that can be used to adhere two or more objects to each other. Types of adhesives include, but are not limited to, epoxies, polyurethanes, polyimides, or cyanoacrylates, silicone, or latex based adhesives. See removable adhesive, pressure sensitive adhesive, heat activated adhesive.

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Aperture: As used in this disclosure, an aperture is a prism-shaped negative space that is formed completely through a structure or the surface of a hollow structure.

Barrier: As used in this disclosure, a barrier is a physical obstacle that forms a boundary between a first space and a second space. The barrier prevents the passage of an object between the first space and the second space.

Boundary Structure: As used in this disclosure, a boundary structure is a barrier that separates a first object from a second object such that the second object cannot damage the first object.

Cant: As used in this disclosure, a cant is an angular deviation from one or more reference lines (or planes) such as a vertical line (or plane) or a horizontal line (or plane).

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Coating: As used in this disclosure, a coating refers to a substance that is applied to the exterior surface of an object such that the coating forms a new exterior surface of the object. A coating is commonly said to be formed as a layer. Paint is an example of a common coating material.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Copolymer: As used in this disclosure, a copolymer is a polymer formed from two or more repeating molecules (also referred to as monomers).

Correspond: As used in this disclosure, the term correspond is used as a comparison between two or more objects wherein one or more properties shared by the two or more objects match, agree, or align within acceptable manufacturing tolerances.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Disposable: As used in this disclosure, disposable is an adjective that refers to an object that is designed and intended for a single use. Within this context, an object would be considered disposable if it is not reusable after its initial use.

Domestic Plumbing System: As used in this disclosure, a domestic plumbing system refers to a fluidic network that is formed within a building. The domestic plumbing system transports water received from a utility through the building. Specifically, the domestic plumbing system: a) receives fresh water from the utility and distributes the fresh water through the building; and, b) transports gray water generated within the building and returns the gray water back to the utility for disposal. The domestic plumbing system comprises a supply side and a DWV.

DWV: As used in this disclosure, DWV is an acronym for drainage, waste, and vent. With a domestic plumbing system, DWV refers to the plumbing subnetwork that transports waste water out of the residence to an appropriate waste water handling system.

Elevation: As used in this disclosure, elevation refers to the span of the distance in the superior direction between a specified horizontal surface and a reference horizontal surface. Unless the context of the disclosure suggest otherwise, the specified horizontal surface is the supporting surface the potential embodiment of the disclosure rests on. The infinitive form of elevation is to elevate.

Elimination: As used in this disclosure, an elimination refers to a solid phase discharge from a biological entity.

Environment: As used in this disclosure, an environment refers to a collection of one or more external processes that that a process interacts with. This definition assumes that a process selected from one or more external processes can be a measured physical condition that the process interacts with.

Excretion: As used in this disclosure, an excretion refers to a liquid phase discharge from a biological entity.

Exterior: As used in this disclosure, the exterior is used as a relational term that implies that an object is not contained within the boundary of a structure or a space.

Flexible: As used in this disclosure, flexible refers to an object or material that will deform when a force is applied to it but that will not necessarily return to its original shape when the deforming force is removed.

Flow: As used in this disclosure, a flow refers to the passage of a fluid past a fixed point. This definition considers bulk solid materials as capable of flow.

Fluid: As used in this disclosure, a fluid refers to a state of matter wherein the matter is capable of flow and takes the shape of a container it is placed within. The term fluid commonly refers to a liquid or a gas.

Fluid Impermeable: As used in this disclosure, the term fluid impermeable refers to: a) the ability of a structure to not allow a fluid to pass through the structure; or, b) the ability of a material not absorb through the exterior surfaces of the material a fluid that the material is immersed in or exposed to.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Gas: As used in this disclosure, a gas refers to a state (phase) of matter that is fluid and that fills the volume of the structure that contains it. Stated differently, the volume of a gas always equals the volume of its container.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1. By the term essentially geometrically similar is meant that the primary shapes of two objects are geometrically similar except that there are functional items (such as fastening devices) associated with the primary shape may not maintain the ratio for geometric similarity. By the term roughly geometrically similar is meant that the form factors between the primary shape of the two objects can vary by a factor of up to 10% when the two objects are normalized to be roughly geometrically identical.

Ground: As used in this disclosure, the ground is a solid supporting surface formed by the Earth. The term level ground means that the supporting surface formed by the ground is roughly perpendicular to the force of gravity. The term underground refers to an object being underneath the superior surface of the ground.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inferior: As used in this disclosure, the term inferior refers to a directional reference that is parallel to and in the same direction as the force of gravity when an object is positioned or used normally.

Interior: As used in this disclosure, the interior is used as a relational term that implies that an object is contained within the boundary of a structure or a space.

Liquid: As used in this disclosure, a liquid refers to a state (phase) of matter that is fluid and that maintains, for a given pressure, a fixed volume that is independent of the volume of the container.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Loop: As used in this disclosure, a loop is the length of a first linear structure including, but not limited to, shafts, lines, cords, or webbings, that is: 1) folded over and joined at the ends forming an enclosed space; or, 2) curved to form a closed or nearly closed space within the first linear structure. In both cases, the space formed within the first linear structure is such that a second linear structure such as a line, cord or a hook can be inserted through the space formed within the first linear structure. Within this disclosure, the first linear structure is said to be looped around the second linear structure.

Monomer: As used in this disclosure, a monomer refers to a molecular structure that bonds to itself in a repeating manner to form a polymer.

Negative Space: As used in this disclosure, negative space is a method of defining an object through the use of open or empty space as the definition of the object itself, or, through the use of open or empty space to describe the boundaries of an object.

Not Significantly Different: As used in this disclosure, the term not significantly different compares a specified property of a first object to the corresponding property of a reference object (reference property). The specified property is considered to be not significantly different from the reference property when the absolute value of the difference between the specified property and the reference property is less than 10.0% of the reference property value. A negligible difference is considered to be not significantly different.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Organic: As used in this disclosure, organic refers to a carbon-based chemical structure. A limited number of carbon-based salts are traditionally considered inorganic chemical structures and are excluded from the study of organic chemistry.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of prism structure of the pan and/or a portion of the closed lateral faces of the pan are open.

Parchment: As used in this disclosure, parchment refers to a silicone impregnated sheet of paper. Parchment is known for having high temperature resistance and for resisting saturation by a liquid.

Peel-Off Strip: As used in this disclosure, a peel-off strip is a parchment sheeting. The peel-off strip is a sacrificial structure that covers an adhesive surface. The peel-off strip protects the adhesive surface from detritus that can accumulate on and the inhibit ability of the adhesive surface to adhere to its targeted destination when the adhesive surface is needed for use. The form factor of the peel-off strip is typically geometrically similar to the forms factor of the adhesive surface with a greater surface area than the surface area of the adhesive surface. The peel-off strip is typically disposable. Use parchment, silicone, sacrificial structure, form factor, detritus, adhesive, disposable. See parchment and silicone.

Perimeter: As used in this disclosure, a perimeter is one or more curved or straight lines that bounds an enclosed area on a plane or surface. The perimeter of a circle is commonly referred to as a circumference.

Phase: As used in this disclosure, phase refers to the state of the form of matter. The common states of matter are solid, liquid, gas, and plasma.

Plastic: As used in this disclosure, plastic refers to a manufactured material that is formed from a structure selected from the group consisting of a polymer or a copolymer. Unless stated otherwise, this disclosure assumes that the plastic is formed from organic monomers.

Polymer: As used in this disclosure, a polymer refers to a molecular chain that comprises multiple repeating units known as monomers. The repeating unit may be an atom or a molecular structure.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Protected Space: As used in this disclosure, a protected space is a negative space within which an object is stored. The protected space is enclosed by a barrier structure that: a) prevents damage to the object contained within the protected space; b) maintains conditions that are appropriate for the object; c) protects the object within the protected space from potential dangers that are outside of the protected space; or, d) maintains the privacy of the object within the protected space.

Removable Adhesive: As used in this disclosure, a removable adhesive is a commercially available adhesive that is designed with a lower tack, or stickiness, such that a first object is attached to a second object with a removable adhesive the first object can be readily removed in a manner that ideally, though not necessarily practically, leaves behind no adhesive residue on the second object. A repositionable adhesive is a subset of removable adhesives that are intended to allow the first object to be reattached to a third object or the second object in the initial or a different position. Within this disclosure, a removable adhesive is assumed to include repositionable adhesives. A removable adhesive is often called fugitive glue.

Ring: As used in this disclosure, a ring is a term that is used to describe a disk-like structure through which a negative space is formed through the faces of the disk-like structure. Rings are often considered loops. The negative space formed through the faces of the disk-like structure is called the characteristic aperture.

Roughly: As used in this disclosure, roughly refers to a comparison between two objects. Roughly means that the difference between one or more parameters of the two compared objects are not significantly different.

Sacrificial Structure: As used in this disclosure, a sacrificial structure is a first object or structure that protects a second object or structure from damage. More specifically, the sacrificial structure protects the second object or structure by being itself damaged instead of the second object or structure.

Sheeting: As used in this disclosure, a sheeting is a material, such as a paper, textile, a plastic, or a metal foil, in the form of a thin flexible layer or layers. The sheeting forms a disk structure. The two surfaces of the sheeting with the greatest surface area are called the faces of the sheeting.

Silicone: As used in this disclosure, silicone is a substance formed from silicon (Si) and oxygen (O) that forms the backbone of polymer type chains similar to polymers that are formed by carbon. Though exceptions do exist, silicone is generally considered to be less reactive and to have better heat resistance when compared to most common carbon based polymers. Solid: As used in this disclosure, a solid refers to a state (phase) of matter that: 1) has a fixed volume; and, 2) does not flow.

Strip: As used in this disclosure, the term describes a long thin object of uniform width. Strips are often rectangular blocks in shape.

Superior: As used in this disclosure, the term superior refers to a directional reference that is parallel to and in the opposite direction of the force of gravity when an object is positioned or used normally.

Supply Side: As used in this disclosure, the supply side refers to the plumbing subnetwork within a domestic plumbing system that provisions fresh water for use within the residence.

Supporting Surface: As used in this disclosure, a supporting surface is a horizontal surface upon which an object is placed and to which the load of the object is transferred. This disclosure assumes that an object placed on the supporting surface is in an orientation that is appropriate for the normal or anticipated use of the object.

Toilet: As used in this disclosure, a toilet is a port into which biological excretions and eliminations are deposited in preparation of introducing the excretions and eliminations into an externally provided waste water handling system. A typical toilet comprises a bowl, a flush mechanism, and a refill mechanism. The bowl forms a structure used to receive and contain the excretions and eliminations. The flush mechanism releases a flow of water that transports the deposited excretions and eliminations into the DWV of a plumbing system. The refill mechanism replenishes the water used by the flush mechanism in anticipation of future use of the toilet. A toilet often further comprises a toilet seat and a toilet lid. The toilet seat allows an individual to sit while depositing excretions and eliminations. The toilet lid encloses the bowl of the toilet. A urinal refers to a toilet like structure that is designed to only receive excretions.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

Vicinity: As used in this disclosure, vicinity refers to the space immediately, or closely, surrounding a first object. A second object is said to be in the vicinity of the first object.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A disposable cover for a toilet and surrounding area comprising a sacrificial sheeting, a plurality of adhesive structures, and a toilet facility;

wherein the plurality of adhesive structures secures the sacrificial sheeting to the toilet facility;

wherein the sacrificial sheeting forms a protected space that protects the toilet facility from the environment;

wherein the sacrificial sheeting keeps the toilet facility in a clean state;

wherein the toilet facility is a facility that is intended to receive eliminations and excretions from an individual;

wherein the toilet facility comprises a toilet structure, a supporting surface, and one or more enclosing surfaces;

wherein the sacrificial sheeting forms a boundary structure;

wherein the sacrificial sheeting forms a protected space that encloses the toilet facility;

wherein the plurality of adhesive structures removably attaches the sacrificial sheeting to the toilet structure;

wherein the plurality of adhesive structures removably attaches the sacrificial sheeting to the supporting surface;

wherein the plurality of adhesive structures removably attaches the sacrificial sheeting to the one or more enclosing surfaces.

2. The disposable cover for a toilet and surrounding area according to claim 1 wherein the toilet structure is a toilet;

wherein the toilet structure further comprises a bowl structure;

wherein the bowl structure is the bowl of the toilet structure;

wherein the bowl structure is a port;

wherein the supporting surface is a horizontally oriented surface;

wherein the supporting surface forms the surface that receives the load of the toilet facility;

wherein each enclosing surface selected from the one or more enclosing surfaces is a vertically oriented surface.

3. The disposable cover for a toilet and surrounding area according to claim 2 wherein the sacrificial sheeting is a sheeting structure;

wherein the sacrificial sheeting is a flexible structure;

wherein the sacrificial sheeting is a fluid impermeable structure;

wherein the sacrificial sheeting is formed from a material selected from the group consisting of: a) a plastic; and, b) a parchment;

wherein the sacrificial sheeting is a disposable structure;

wherein the sacrificial sheeting is intended for a single use.

4. The disposable cover for a toilet and surrounding area according to claim 3 wherein the sacrificial sheeting comprises a characteristic aperture, an exterior face, and an interior face;

wherein the characteristic aperture is a negative space that forms the characteristic aperture of the ring structure of the sacrificial sheeting;

wherein the characteristic aperture provides a port that allows eliminations and excretions to be deposited into the bowl structure of the toilet facility;

wherein the interior face is a face of the sheeting that forms the sacrificial sheeting;

wherein the interior face is the face of the sacrificial sheeting that is proximal to the toilet structure when the sacrificial sheeting is deployed on the toilet facility;

wherein the exterior face is a face of the sheeting that forms the sacrificial sheeting;

wherein the exterior face is the face of the sacrificial sheeting that is distal from the interior face.

5. The disposable cover for a toilet and surrounding area according to claim 4 wherein the plurality of adhesive structures forms an adhesive structure;

wherein the plurality of adhesive structures is formed with a removable adhesive;

wherein the plurality of adhesive structures maintain the deployed sacrificial sheeting in a fixed position on the toilet facility.

6. The disposable cover for a toilet and surrounding area according to claim 5 wherein the plurality of adhesive structures comprises a collection of individual adhesive structures;

wherein each individual adhesive structure selected from the plurality of adhesive structures comprises an adhesive coating and a peel-off strip;

wherein the peel-off strip attaches to the adhesive coating.

7. The disposable cover for a toilet and surrounding area according to claim 6 wherein each adhesive coating selected from the plurality of adhesive structures is a chemical compound;

wherein each selected adhesive coating is a removable adhesive;

wherein each selected adhesive coating is applied as a coating to the one or more enclosing surfaces of the sacrificial sheeting;

wherein the selected adhesive coating attaches the sacrificial sheeting to a surface selected from the group consisting of: a) the toilet structure; b) the supporting surface, and, c) the one or more enclosing surfaces.

8. The disposable cover for a toilet and surrounding area according to claim 7 wherein the peel-off strip is a parchment;

wherein the shape of the peel-off strip is geometrically identical to the shape of the coating formed by the adhesive coating;

wherein the peel-off strip is removed before the adhesive coating is adhered to a receiving surface.

* * * * *